US006971123B2

(12) United States Patent
Weaver

(10) Patent No.: US 6,971,123 B2
(45) Date of Patent: Dec. 6, 2005

(54) TRAINING DEVICE FOR FOOTBALL

(76) Inventor: Steven D. Weaver, 1599 Roxbury Rd., Columbus, OH (US) 43212

( * ) Notice: Subject to any disclaimer, the term of this patent is extended or adjusted under 35 U.S.C. 154(b) by 0 days.

(21) Appl. No.: 10/617,984

(22) Filed: Jul. 11, 2003

(65) Prior Publication Data

US 2004/0064874 A1 Apr. 8, 2004

Related U.S. Application Data

(60) Provisional application No. 60/395,797, filed on Jul. 16, 2002.

(51) Int. Cl.[7] ..... A41D 13/00
(52) U.S. Cl. ..... 2/468; 2/411; 2/422; 2/425; 2/461
(58) Field of Search ..... 2/425, 468, 421, 2/416, 411, 422, 461

(56) References Cited

U.S. PATENT DOCUMENTS 1,136,307 A * 4/1915 Bourdon ..... 2/456
3,134,106 A * 5/1964 Shaffer et al. ..... 2/462
3,671,974 A * 6/1972 Sims ..... 2/421
3,818,509 A * 6/1974 Romo et al. ..... 2/421
3,873,996 A * 4/1975 Varteressian ..... 2/421
3,900,896 A * 8/1975 Ackerman ..... 2/468
4,219,193 A * 8/1980 Newman ..... 482/10
4,319,362 A 3/1982 Ettinger
4,338,685 A 7/1982 LaPorta, Jr.
4,501,023 A 2/1985 Bilberry
5,123,408 A * 6/1992 Gaines ..... 602/17
5,371,905 A * 12/1994 Keim ..... 2/413
5,546,601 A 8/1996 Abeyta
6,006,368 A * 12/1999 Phillips ..... 2/468
6,182,300 B1 2/2001 Severance
6,330,722 B1 * 12/2001 Betts ..... 2/416

* cited by examiner

*Primary Examiner*—Rodney M. Lindsey
(74) *Attorney, Agent, or Firm*—Calfee, Halter & Griswold LLP

(57) ABSTRACT

A football training aid including a device that detachably connects a football player's helmet to the player's shoulder pads, thereby and reducing the tendency and/or ability of the player to lower his head while wearing said device. The exemplary embodiment of the device provides a substantially "T" shaped piece of vinyl, polyurethane, or other resilient material in a length adequate to connect the rear portion of the helmet to a rear portion of the shoulder pads. The present invention also includes several attachment methods for attaching the training device to the helmet and shoulder pads, including VELCRO® strips and a plurality of snaps.

6 Claims, 4 Drawing Sheets

TRAINING DEVICE FOR FOOTBALL

CROSS-REFERENCE TO RELATED APPLICATIONS

This application claims the benefit of U.S. Provisional Application No. 60/395,797, filed on Jul. 16, 2002, entitled "The Helmet/Shoulder Pad Neck Stabilizer," the disclosure of which is incorporated as if fully rewritten herein.

TECHNICAL FIELD OF THE INVENTION

The present invention relates generally to training aids for athletic activities, and more specifically to a device for limiting the forward movement of an athlete's head while engaged in football training exercises.

BACKGROUND OF THE INVENTION

Substantial physical contact is an integral part of American style football. Football players forcibly strike one another throughout the course of a game, and very often throughout the course of training exercises such as practice drills and scrimmages. While the protective padding worn by football players has improved over the years, players of all ages and skill levels still suffer a significant number of football-related injuries every year. One common and potentially very serious injury involves trauma to the cervical area of the spine. Such injuries most often occur when a first player lowers his head in a reflexive manner in response to a second player attempting to tackle or block the first player. If the first player lowers his head too far beyond the "safe" position, the force of the second player striking the first player's helmet can result in a strained cervical area, or far worse, significant compression of the cervical area, and possibly a broken neck. These types of injuries often result in temporary or permanent paralysis.

The above described problem has been long been recognized by individuals skilled in the art of designing padding and protective gear for athletes. A variety of cervical stabilizers for football players are taught in the patent prior art; however, these devices suffer from significant limitations that, in many cases, make them unsuitable for commercialization or simply impractical. More specifically, such prior art devices tend to be overly complex in their construction or they create as many problems as they solve. In particular, while such devices may reduce some of the undesirable forward motion of the head, they unnecessarily restrict left-to-right, backward or side-to-side motion of the head. As a result, the player is faced with an unnatural feeling, cumbersome, and uncomfortable device. Thus, there is a need for a football training device that restricts forward motion of the head, but that allows for flexibility in other directions.

SUMMARY OF THE INVENTION

These and other deficiencies of the prior art are overcome by the present invention which provides a football training aid in the form of a device that detachably connects a football player's helmet to the player's shoulder pads, thereby reducing the tendency and/or ability of the player to lower his head while wearing the device. The exemplary embodiment of the device provides a substantially "T" shaped piece of vinyl, polyurethane, neoprene rubber, or other resilient material in a length adequate to connect the rear portion of the helmet to a rear portion of the shoulder pads. The present invention also includes several attachment methods for attaching the training device to the helmet and shoulder pads, including VELCRO® strips and a plurality of snaps.

By providing significant resistance to undesirable forward movement of the head and chin in an impact or collision situation, the present invention encourages the user of the device to develop proper fundamentals and technique, thereby reducing the likelihood of serious injury to the athlete. When used in the context of practice and training, the present invention teaches the user to keep his head up while participating in the game of football. Advantageously, this device allows the user's head to rotate from left-to-right, backwards, and from side-to-side in a natural manner making it a comfortable piece of training equipment. This invention also reduces the likelihood that a player's helmet will become dislodged during an impact or collision and, consequently, reduces the possibility of head and facial injuries and concussions.

Further advantages of the present invention will become apparent to those of ordinary skill in the art upon reading and understanding the following detailed description of the preferred embodiments.

BRIEF DESCRIPTION OF THE DRAWINGS

The accompanying drawings, which are incorporated into and form a part of the specification, schematically illustrate exemplary embodiments of the invention and, together with the general description given above and detailed description of the preferred embodiments given below, serve to explain the principles of the invention.

DETAILED DESCRIPTION OF THE INVENTION

Reference Numerals

Figure 1:
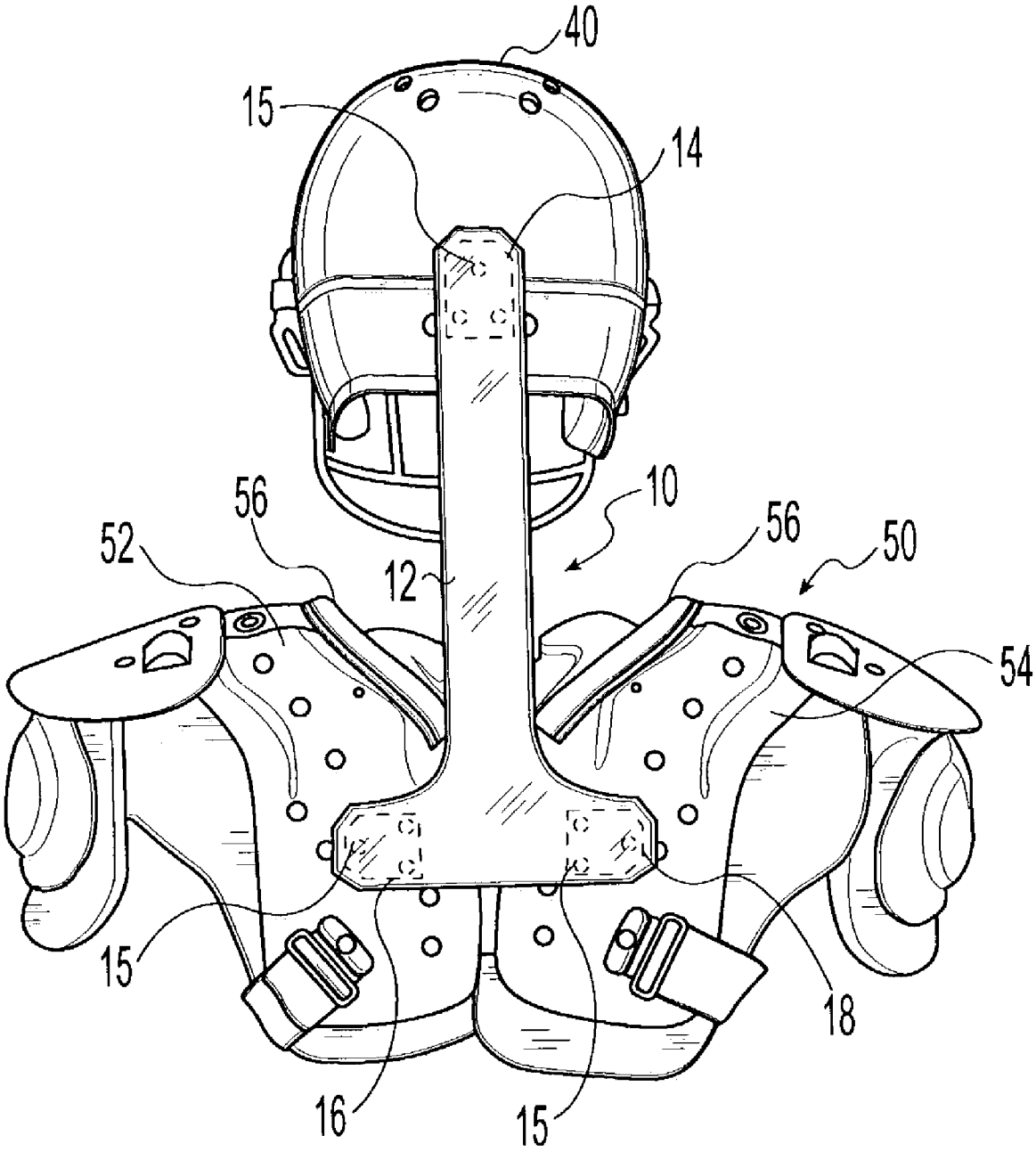
FIG. 1 is a rear-view of the present invention showing the training device properly mounted on the rear portion of a football helmet and on the rear portions of a pair of shoulder pads utilizing either the VELCRO® attachment method or the snap attachment method.

10 training device
12 elongated portion
14 first attachment member
15 snap
16 second attachment member
18 third attachment member
30 first substrate
32 second substrate
34 third substrate
40 helmet
50 shoulder pad assembly
52 first support

54 second support

56 stitched collar

The present invention provides a device that potentially reduces the risk of cervical injury to persons engaged in the game of football when such persons are wearing protective gear that includes helmets and shoulder pads. In the exemplary embodiments shown in the Figures, a first portion of this device, which may be manufactured from a resilient material such as plastic, vinyl or rubber, is typically attached to back portion of a player's helmet while a second portion of this device is attached to both the left and right-hand portions of the plastic exterior of a player's shoulder pads.

With reference to the Figures, FIG. 1 shows the device of the present invention properly installed on a football helmet and shoulder pad assembly. Training device 10 is substantially T-shaped, although inverted when in use, and includes an elongated portion 12 that connects first attachment member 14 to the top or crossbar portion of the "T" shape and which includes second attachment member 16 and third attachment member 18.

In the exemplary embodiment, training device 10 is detachably connected to both helmet 40 and shoulder pad assembly 50 by means of VELCRO® patches that have been mounted both on training device 10 and on the helmet and shoulder pads. VELCRO® is a widely available commercial product that includes two pieces of fabric, one having loops, the other having hooks, that stick together in a stable, yet easily separable manner. Each piece of fabric is typically attached by adhesive means to one of two or more separate substrates that are then attached to one another using this system of loops and hooks. In the embodiment shown in FIG. 1, a piece of the looped fabric has been attached to the underside of first attachment member 14 and pieces of the looped fabric have been attached to the underside of both second attachment member 16 and third attachment member 18.

Figure 2:
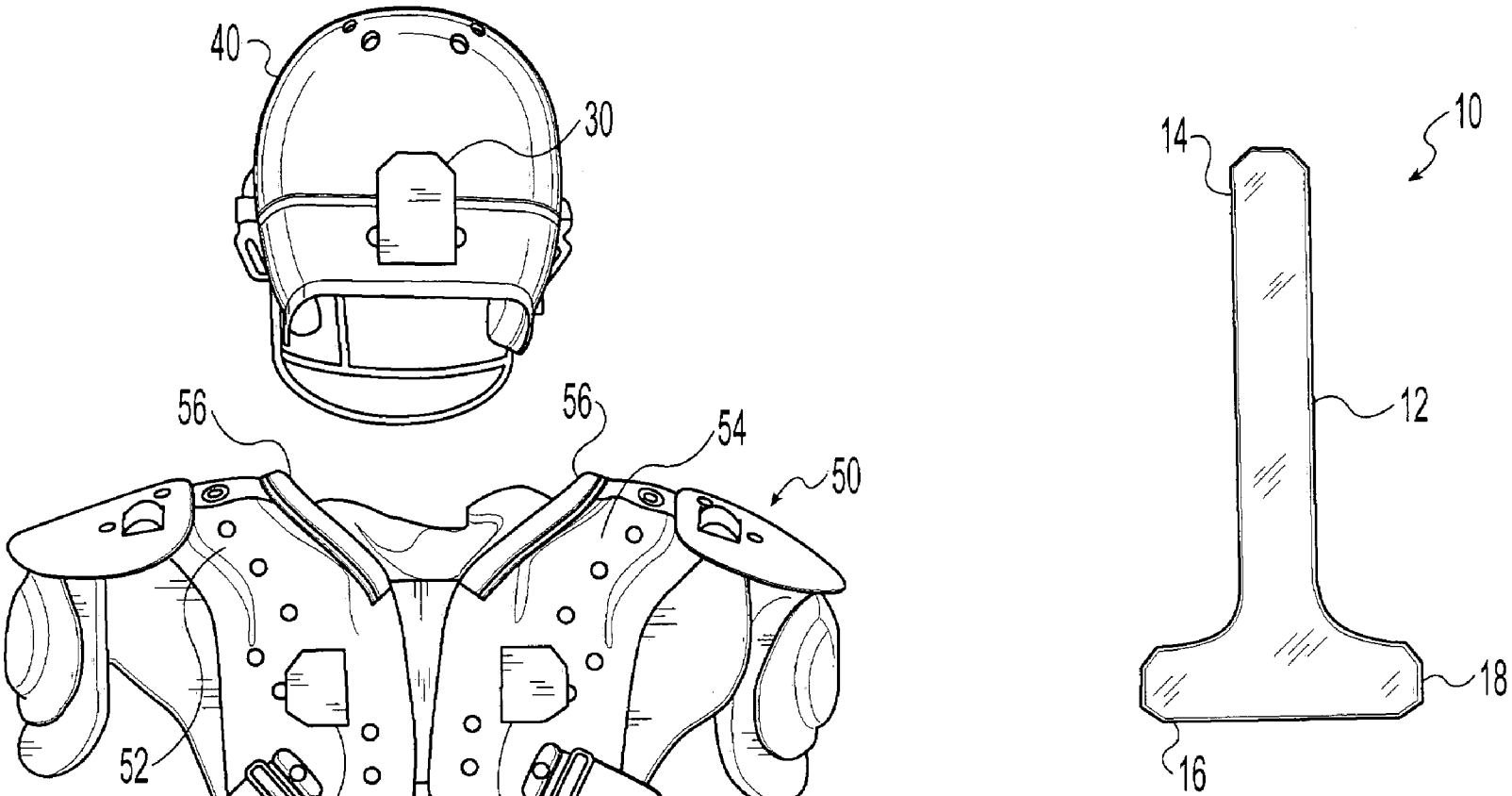
FIG. 2 is a rear-view of the present invention showing the training device removed from the helmet and shoulder pads to reveal the proper placement of the mounting substrates to which the device is attached.

As shown in FIG. 2, a piece of the hooked material is attached to the back of helmet 40 to form first substrate 30 and two additional pieces of the hooked material are attached to first support 52 and second support 54 on shoulder pad assembly 50 to form second substrate 32 and third substrate 34. These substrates are roughly equal in size and dimensions to the pieces of looped material that are attached to the three attachment members.

Figure 3:
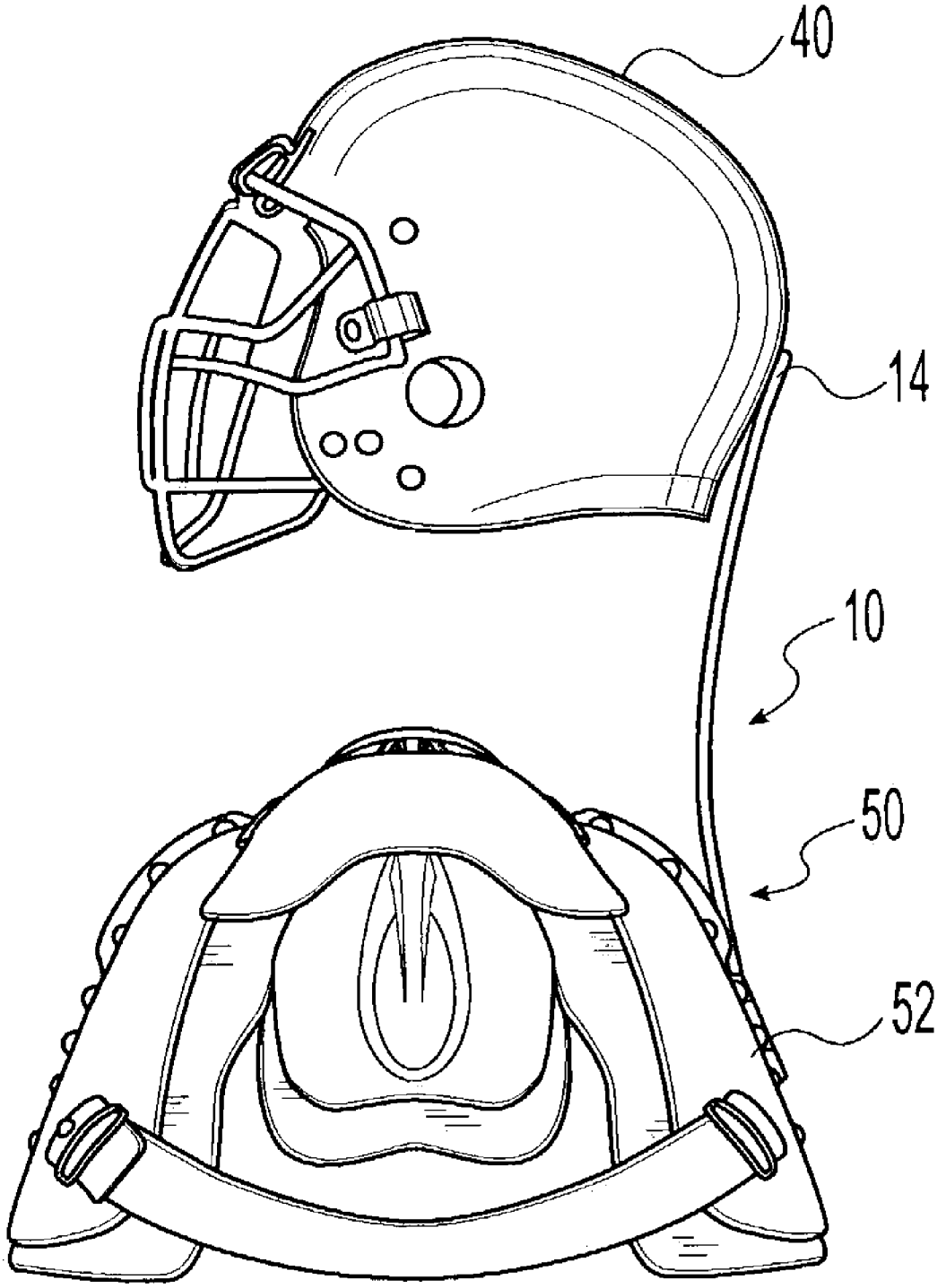
FIG. 3 is a side-view of the present invention showing the training device properly mounted on the rear portion of a football helmet and on the rear portions of a pair of shoulder pads.
Figure 4:
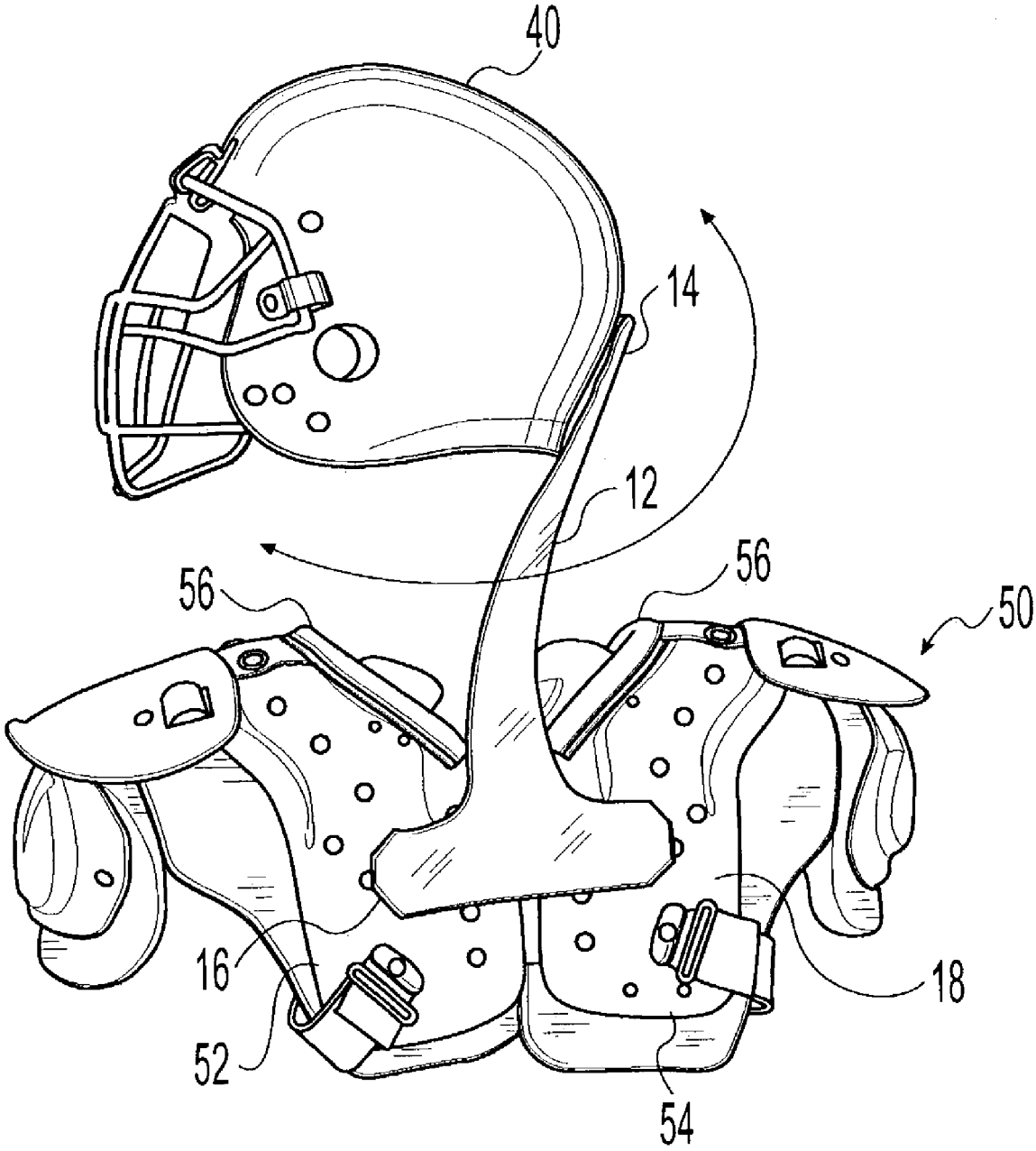
FIG. 4 is a rear-view of the present invention illustrating that the wearer or end-user of the present invention will have a relatively free range of left-to-right, backwards and side-to-side motion when the device is properly installed.

After the substrates have been attached to the helmet and to the shoulder pads, football training device 10 is installed by simply placing the attachment members in contact with the corresponding substrates and pressing down to engage the VELCRO® surfaces (see FIGS. 1 and 2). Once properly installed, training device 10 discourages the football player from lowering his head when he encounters a collision or impact situation by providing significant resistance to any forward and/or downward motion. Although the undesirable forward and/or downward motion is significantly reduced by the presence of training device 10, the player's left-to-right, backward and side-to-side head movement is not restricted (see FIGS. 3 and 4). Training device 10 may also be quickly and easily removed simply by grasping the device and pulling outward, thereby disengaging the loops from the hooks on the VELCRO® surfaces.

The present invention may be offered to the end user as separate components or as a kit that contains the training device and the items required for mounting the device on a helmet and shoulder pad assembly. An exemplary embodiment of such a kit includes the device itself, a number of VELCRO® strips, and a set of instructions for sizing and mounting the device. The contents of the kit and the methods for installing the device are described in greater detail below.

As previously stated, the training device of the present invention resembles an inverted letter "T" when properly installed. In an exemplary embodiment, the entire device is about 16.0 inches (40.6 cm) in length, the base or narrow end of the "T," which forms first attachment member 14 (see FIG. 2) is about 2.0 inches (5.0 cm) in width, the neck or hozel portion of the device is about 2.0 inches (5.0 cm) in width, and the cross bar of the "T," which includes second attachment member 16 and third attachment member 18 is about 7.0 inches (17.8 cm) in length. Training device 10 may be made from a variety of materials including, but not limited to, 0.125 inch (0.32 cm) neoprene rubber 70 (+/−5 durometer at 1,200 psi), 0.125 inch (0.32 cm) vinyl 70 (+/−5 durometer at 1,200 psi) and/or 0.125 inch (0.32 cm) polyurethane 85 (+/−durometer at 7,500 psi) (made by Novitane). This type of vinyl and/or polyurethane may be obtained from Aero Rubber Co., Inc. 7501 West 99th Street, Bridgeview, Ill. 60455.

The loop portion of the VELCRO® may be attached to the training device prior to the sale of the kit. In an exemplary embodiment, a 2.0 inch wide by 12.0 inch long (5.0 cm×30.5 cm) piece of VELCRO® loop strip is secured to the underside of the hozel or neck, a 2.0 inch wide by 3.0 inch long (5.0 cm×7.6 cm) piece of VELCRO® loop strip is secured to the left portion if the underside of the base to form attachment member 16 and a 2.0 inch wide by 3.0 inch long (5.0 cm×7.6 cm) piece of VELCRO® loop strip is secured to the right portion of the underside of the base to form attachment member 18.

The kit version of the present invention involves placement of the substrates (i.e., the VELCRO® hook strips) by the end user on the back of the helmet and shoulder pad assembly. Pre-cut hook strips are included as part of the kit in the exemplary embodiment. Thus, the user may install the device of the present invention according to the following exemplary method:

(i) clean the back of the helmet with a mild detergent and water;

(ii) remove the protective backing from the 3.5 inch (8.9 cm) hook strip, place it on the base of the back portion of helmet 40 (see FIG. 2,) and press down to create first substrate 30 (note: if the helmet has a rubber name plate, place the hook strip above it; if there is a ridge, cut the strip into two pieces and place one piece below and one piece above the ridge);

(iii) clean the back of the shoulder pads with a mild detergent and water;

(iv) remove the protective backing from one of the 3.0 inch (7.6 cm) hook strips and place it about 1.0 inches (2.54 cm) down from the stitched collar on the left portion of the shoulder pads and about 0.5 inches (1.27 cm) from the left inside edge of the shoulder pad (see FIG. 2) and press down to create second substrate 32;

(v) to create third substrate 34, repeat the previous step for the right side of the shoulder pads taking care to place the strips at the same relative position on each shoulder pad.

Proper sizing of training device 10 may be accomplished according to the following exemplary method:

(i) the end user, wearing both the shoulder pads and helmet, stands up straight and looks forward while holding their head and chin at a 90° angle to their body;

(ii) a second person places the looped strips over the corresponding hooked strips and presses down to attach the training device to the helmet and shoulder pads (see FIG. 1);

(iii) the second person locates the top of the hooked strip on the back of the helmet, marks its location on the training device and cuts off (horizontally) any excess material at the top of the device with a pair of household scissors or similar device; and (iv) the second person then cuts off each corner of first attachment member 14 at a 45° angle to the neck of the device (see FIG. 2).

As shown by the dashed circles in FIG. 1, an alternate embodiment of the present invention utilizes a different attachment means for securing the device to the helmet and shoulder pads. In this embodiment, the VELCRO® has been replaced by a plurality of snaps 15 located on the various attachment members as well as on the helmet and the shoulder pads. The dashed circles in FIG. 1 indicate, by way of example, the placement of these snaps. In this embodiment, the materials and dimensions of training device 10 are basically the same as for the embodiment utilizing the VELCRO® attachment means; however, the contents of the kit differ as does the basic method for attaching the device to the helmet and shoulder pads.

In an alternate embodiment of the present invention, the kit includes the device itself, having six predrilled holes, three on each side of the portion of device that attaches to the shoulder pads, as well a variety of attachment accessories including, for example, short t-nuts, ⅜ inch screw studs (#8–32), snap sockets, snap screws, a self-adhesive helmet template, a self-adhesive shoulder pad template the corresponds to the pre-drilled holes in the training device, and a self-adhesive positioning template for determining the proper attachment points of the device to the helmet. Using these components, the training device may be properly installed, i.e., attached to the helmet 40 and shoulder pad assembly 50 according to the following exemplary method:

(i) remove the protective backing from the adhesive on the underside of the 2.0 inch wide by 3.5 inch long (5 cm×8.9 cm) helmet template and align the bottom line on the front of the template with the bottom edge of the back of the helmet and the center line with the center of the back of the helmet and press down to attach the template to the helmet (note: if the helmet has a rubber name plate place the template strip directly above the name plate);

(ii) remove the protective padding from the inside of the helmet;

(iii) using a 13⁄64 drill bit, drill holes completely though the material of the helmet where indicated by the circles on the template;

(iv) from the inside of the helmet, insert a T-nut into each of the drilled holes;

(v) remove the template from the back of the helmet;

(vi) using a screwdriver, attach a screw stud to each T-nut on the outside of the back of the helmet (note: there should be three screw studs secured in a triangular pattern on the back of the helmet when this step has been completed);

(vii) reinsert the protective padding back into the interior of the helmet;

(viii) measure about 1.0 inches (2.54 cm) down from the stitched collar on the each side of the shoulder pads and mark this location horizontally with a piece of masking tape or similar material;

(ix) remove the protective backing from the 2.0 inch wide by 7.0 inches long (5.0 cm×17.8 cm) shoulder pad template, match the straight line on the template with the edge of the masking tape and press down on the template to attach it to the shoulder pad; i.e., to both first support 52 and second support 54;

(x) remove the protective padding from the shoulder pads, and using a 16⁄34 drill bit, drill holes completely through the material of both the first and second plastic supports where indicated by the circles on the template;

(xi) from the inside of the shoulder pads, insert a T-nut into each drilled hole and then remove the template from the shoulder pads;

(xii) attach a screw stud to each T-nut using a screwdriver (note: there should be three screw studs secured in a triangular formation on both the left and right side on the back of the shoulder pad;

(xiii) reattach the protective padding to the inside of the shoulder pads;

(xiv) invert and insert a T-nut through the top or outward facing portion of the training device and with a screw, attach a socket to each T-nut protruding inward through the six-predrilled holes; each socket should face inward to engage the screw studs attached to first support 52 and second support 54;

(xv) attach the 2.0 inch wide by 12.0 inches long (5.0 cm×30.5 cm) positioning template to the underside of training device 10;

(xvi) with the end-user wearing the helmet and shoulder pads and standing up straight while holding their head and chin at a 90° angle to their body, a second person attaches the training device to the shoulder pads by pressing the sockets firmly against the screw studs;

(xvii) the second person locates the top screw stud on the back of the helmet and matches it with one of the numbered, centrally located circles on the positioning template (note: there are also two circles slightly lower and on either side of each centrally located circle, each bearing the same number as the corresponding centrally located circle);

(xviii) detach the device from the end-users gear and using a 16⁄34 drill bit, drill three holes though the training device where indicated by the appropriate numbered circles, on the positioning template and invert and insert T-nuts through each of the holes;

(xix) insert screws into each socket and attach the sockets to the each of the T-nuts on the training device to create a plurality of snaps that are oriented in the same manner as the six snaps previously mounted on the second and third attachment members of the training device 10;

(xx) attach the training device to the shoulder pads and to the helmet by contacting the sockets with the screw studs and pressing firmly to snap the pieces together.

As with the embodiment utilizing VELCRO® as the attachment means, the embodiment utilizing the snap attachment means may be removed by simply pulling outward on the device. It should be emphasized that both exemplary embodiments of the present invention disclosed herein are contemplated for use in the context of practice drills or scrimmages, and are not necessarily meant to function as permanent attachments or accessories to the protective gear worn by athletes during actual competitive games.

While the above description contains many specificities, these should not be construed as limitations on the scope of the invention, but rather as exemplification of certain preferred embodiments. Numerous other variations of the present invention are possible, and is not intended herein to mention all of the possible equivalent forms or ramifications of this invention. Various changes may be made to the present invention without departing from the scope or spirit of the invention.

What is claimed:

1. A football training device for use with football helmets and shoulder pads comprising:

(a) a substantially T-shaped piece of resilient material of predetermined length, wherein the substantially T-shaped piece of resilient material further comprises:

(i) an elongated portion, wherein the elongated portion further comprises a first attachment member; and (ii) a crossbar portion, wherein the crossbar portion further comprises a second attachment member and a third attachment member; and (b) means for detachably connecting the first attachment member to a football helmet, a means for detachably connecting the second attachment member to a left shoulder pad, and a means for detachably connecting the third attachment member to a right shoulder pad.

2. The training device of claim 1, wherein the length of the device is about 16.0 inches (40.6 cm) and wherein the widest portion of the device is about 7.0 inches (17.8 cm).

3. The training device of claim 1, wherein the device is packaged in a kit, and wherein the kit further comprises a plurality of adhesive templates for properly locating the device on the helmet and the shoulder pads.

4. The training device of claim 1, wherein the resilient material is plastic, polymer, vinyl, polyurethane, rubber, or combinations thereof.

5. The training device of claim 1, wherein each connecting means further comprises a first piece of fabric having hooks and a second piece of fabric having loops, wherein the hooks engage the loops to hold the pieces of fabric together.

6. The training device of claim 1, wherein each connecting means further comprises a plurality of snaps.

* * * * *